United States Patent [19]

Phillips

[11] 4,240,357

[45] Dec. 23, 1980

[54] FOLDING RAIL CAR DOORS

[75] Inventor: Thomas E. Phillips, McDonald, Ohio

[73] Assignee: The Youngstown Steel Door Company, Cleveland, Ohio

[21] Appl. No.: 2,462

[22] Filed: Jan. 10, 1979

[51] Int. Cl.[3] ..... B65J 1/22

[52] U.S. Cl. ..... 105/378; 105/410; 160/113; 410/5; 410/26

[58] Field of Search ..... 105/368 R, 258, 280, 105/282 P, 294, 295, 305, 378; 296/147, 148; 160/205, 113, 203; 410/3, 5, 26

[56] References Cited

U.S. PATENT DOCUMENTS

| | | | |
|---|---|---|---|
| 382,934 | 5/1888 | Arms | 119/11 |
| 701,551 | 6/1902 | Edwards | 160/203 |
| 1,040,817 | 10/1912 | Tutwiler | 160/113 |
| 1,086,603 | 2/1914 | Merker | 160/91 |
| 3,516,366 | 6/1970 | Bradford | 105/378 |
| 3,677,193 | 7/1972 | Pringle | 410/5 |
| 3,677,197 | 7/1972 | Hounshell | 105/378 |
| 3,854,425 | 12/1974 | Allen | 410/26 |
| 3,911,831 | 10/1975 | Blunjen | 105/378 |
| 3,938,446 | 2/1976 | Seitz | 105/378 |

OTHER PUBLICATIONS

Railway Freight Traffic-Dec. 1955, pp. 22-23, Mar. 1957, p. 23.

Car and Locomotive Cyclopedia, pp. S2-1 to S2-10 (3rd ed. 1974).

*Primary Examiner*—Richard A. Bertsch

*Attorney, Agent, or Firm*—John H. Mulholland

[57] ABSTRACT

A rail car having an interior cavity defined partially by vertical rail car side walls and a roof structure with an inwardly and upwardly directed portion to improve car clearance is disclosed. Access to the cavity for loading and unloading lading is through an end opening. A pair of door assemblies, each of which includes a plurality of panels, each panel of which is pivotally movable with respect to the others, are included for closing the end opening. Pivot means for mounting each of the door assemblies are provided to move the door assemblies between their respective folded open positions and unfolded closed positions. The pivot means are mounted for movement toward and away from the interior of the rail car to permit storage of the folded door assemblies within the rail car along the car side walls. Top panel portions extend from the top of the door assemblies angularly inwardly relative to the opening and in spaced relation with each other and the roof structure. The angle of the top panel portions, the space between each of the top panel portions and every other top panel portion and the spacing of the top panel portions from said roof structure all being of such magnitude that when said door assemblies are in the unfolded closed position, the end opening portion above the door assemblies is substantially closed, and when the panels are pivotally moved from the unfolded closed position to the folded open position and to storage along the rail car side walls and back, each of the top panel portions clears every other top panel portion and the roof structure sufficiently for movement relative thereto.

10 Claims, 7 Drawing Figures

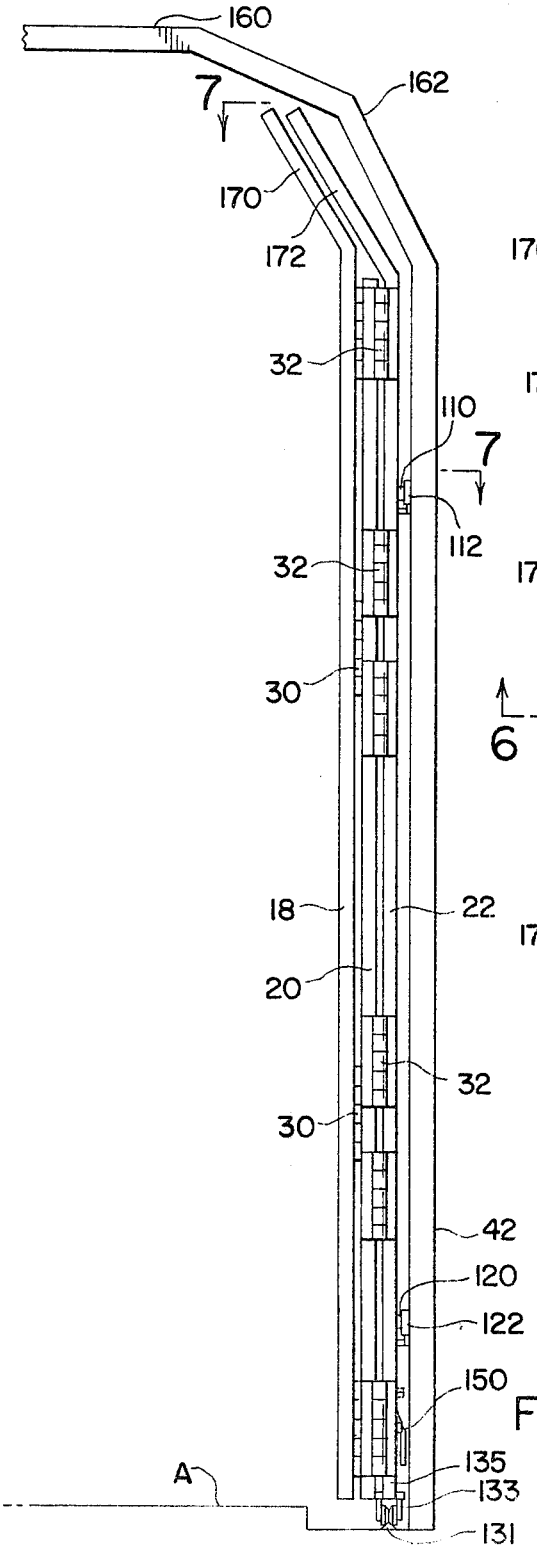
FIG. 6
FIG. 7
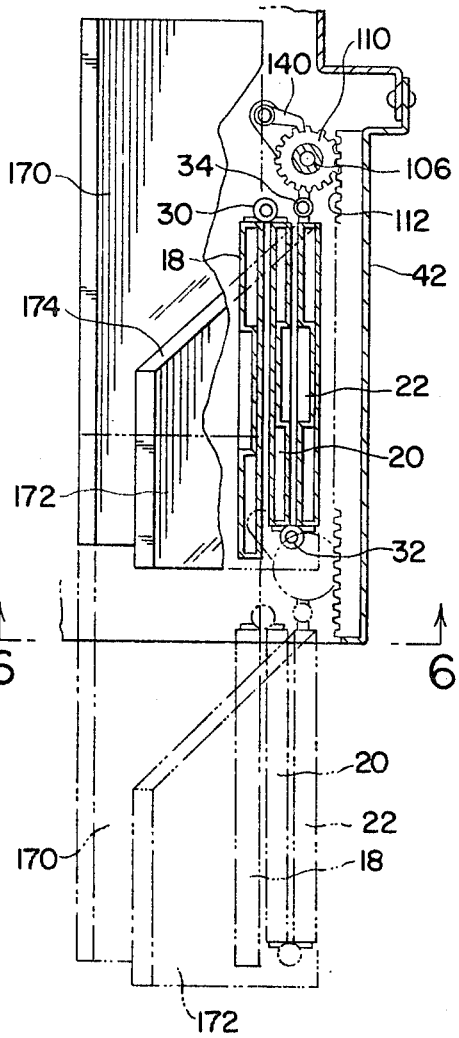

FOLDING RAIL CAR DOORS

BACKGROUND OF THE INVENTION

Broadly, it has been known to use multiple panel folding doors on the ends of multi-decked automobile transit rail cars to prevent vandalism, pilferage and unauthorized entry during transit of the car. An example of such a car is the subject of U.S. Pat No. 3,938,446 issued Feb. 17, 1976 and illustrated in CAR AND LOCOMOTIVE CYCLOPEDIA, p. S4-29, (3d ed. 1974); (Simmons-Boardman Publishing Corporation). The instant invention discloses an improved multiple panel folding door combination with upper deck closing extensions particularly designed and oriented to permit moving the door assemblies into and out of the folded storage position with an interior car cavity defined partially by vertical rail car side walls and a roof structure with an inwardly and upwardly directed portion to improve car clearance.

The requirement of the inwardly and upwardly directed portion of the roof structure for adequate car clearance will be readily appreciated upon an understanding of the section entitled "Fundamentals for Design Fabrication and Construction of Freight Cars" in CAR AND LOCOMOTIVE CYCLOPEDIA, id., p. S2-1 to S2-10. For purposes of interchange of rail cars between different rail lines in the United States, the clearance standards explained in the cited material must be uniformly observed as design parameters. Accordingly, in order to maximize the height of an automobile transit rail car to the point where three auto hauling decks may be utilized while still meeting the clearance diagrams promulgated and adopted for interchange cars by the Association of American Railroads, it is necessary to provide an inwardly and upwardly directed roof portion.

A particular design problem has been encountered because of the necessity of an inwardly and upwardly directed roof structure and multi-decked automobile transit rail cars in that the straight vertical multiple panels of folding doors, if upwardly extended sufficiently to substantially close the interior cavity in the region of the upper deck, will not be capable of inward movement to the position of storage along the inside rail car wall upon being pivotally folded back upon each other to the open position. The new multiple panel folding door combinations of the instant invention provides substantially complete closing of the car end opening and yet solve this storage problem.

SUMMARY OF THE INVENTION

The novel door combinations of the invention are used in a method of closing the end opening of a closed rail car. The doors are of folded panel type and are provided with top panel portions which extend from the top of the door assemblies angularly inwardly relative to the plane of the end opening and main door panels and in spaced relation with each other and the roof structure. The degree of angularity, the spaces between each of the top panel portions and every other top panel portion and the roof structure are of such magnitude that when the door assemblies are in closed position the end opening portion above the door assemblies is substantially closed. In the preferred embodiment, the angle of the top panel portions with respect to the panels approximates the angle of the clearance diagram dictated by the inwardly and upwardly directed portion of the roof structure. When the panels are pivotally moved from the unfolded closed position to the folded open position and then to storage along the rail car side walls, and back, each of the top panel portions clears every other top panel portion and the roof structure sufficiently for movement relatively thereto. Because of this arrangement, it is possible to close the end opening substantially completely for the prevention of vandalism and pilferage and yet when the multiple panel folding door assemblies are folded into open position they may be moved into storage position along the inside rail car wall. Accordingly, the prior art problem of three deck auto transit rail cars having an opening above the storable multiple panel folding door assemblies through which access could be gained by trespassers and thieves is eliminated.

BRIEF DESCRIPTION OF THE DRAWINGS

FIG. 6 is a view similar to FIG. 5 showing a door combination in folded open and stored position.

FIG. 7 is a cross-sectional view taken along the line 7—7 of FIG. 6 showing the door in folded open and unstored position in phantom.

DETAILED DESCRIPTION OF AN EMBODIMENT OF THE INVENTION

In the embodiment illustrated, the numeral 10 generally designates a rail car.

Figures 1, 2:
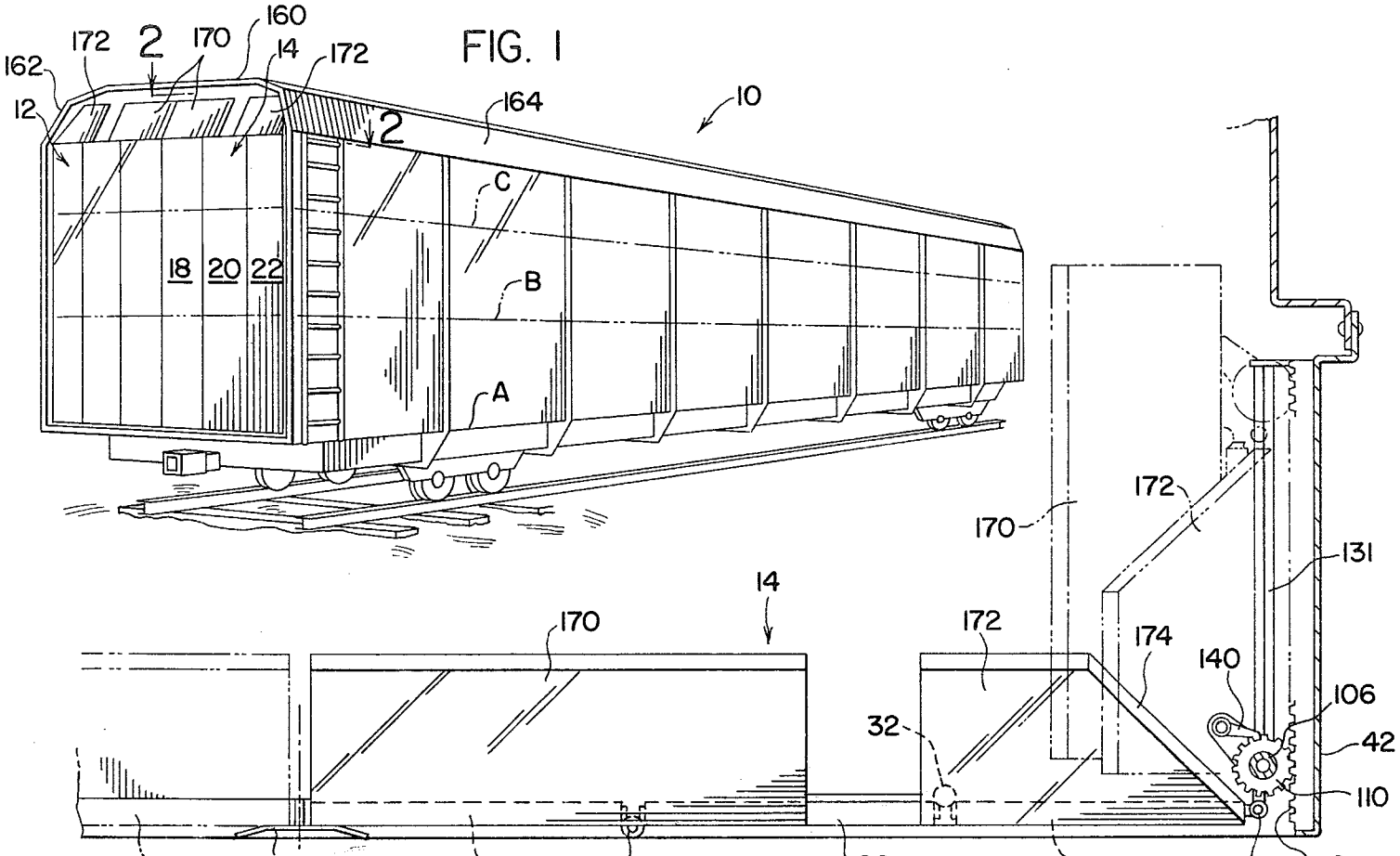
FIG. 1 is a prospective view of a multi-decked automobile transit rail car having folding rail car doors constructed according to the principles of this invention.
FIG. 2 is a cross-sectional view taken along the line 2—2 of FIG. 1 showing the door in folded open and stored position in phantom.
Figure 3:
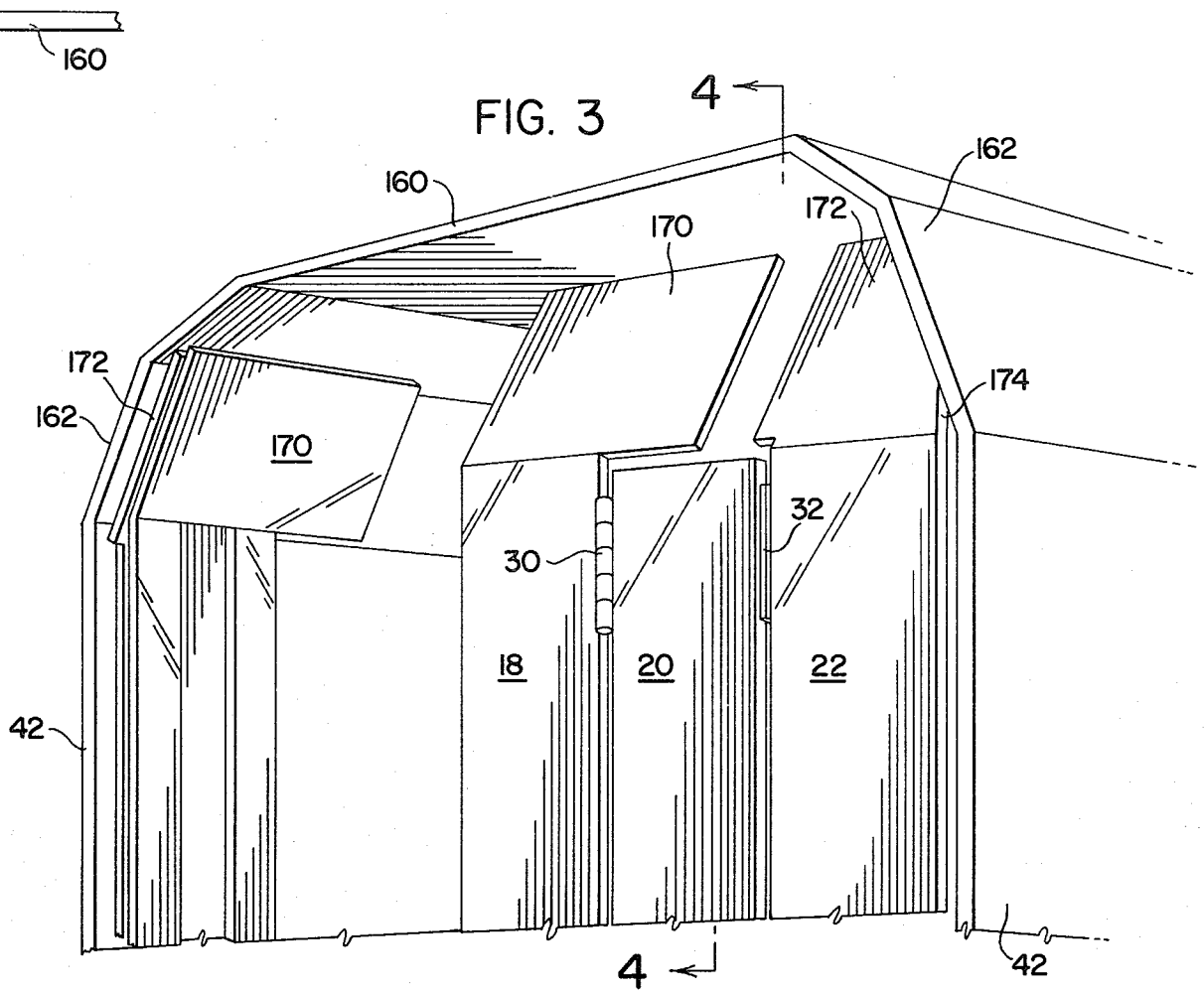
FIG. 3 is an enlarged fragmentary prospective view of the upper portion of the rail car of FIG. 1 illustrating one door combination in folded open storage position and one in unfolded closed position.
Figure 4:
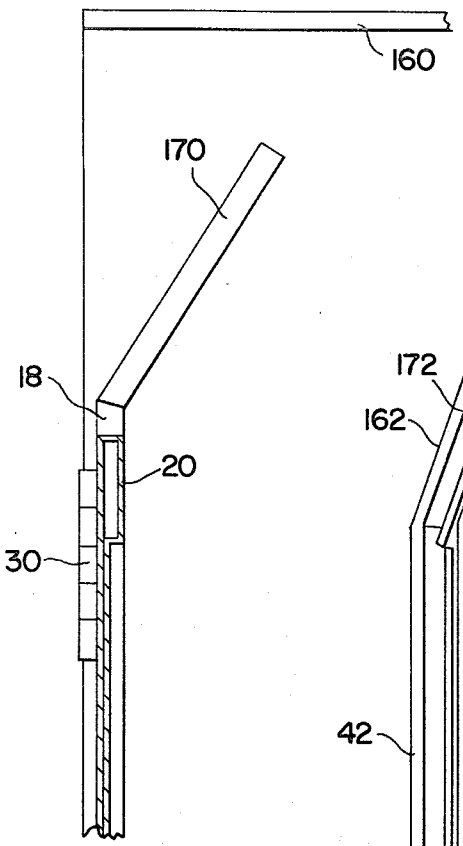
FIG. 4 is a cross-sectional view taken along the line 4—4 of FIG. 3.
Figure 5:
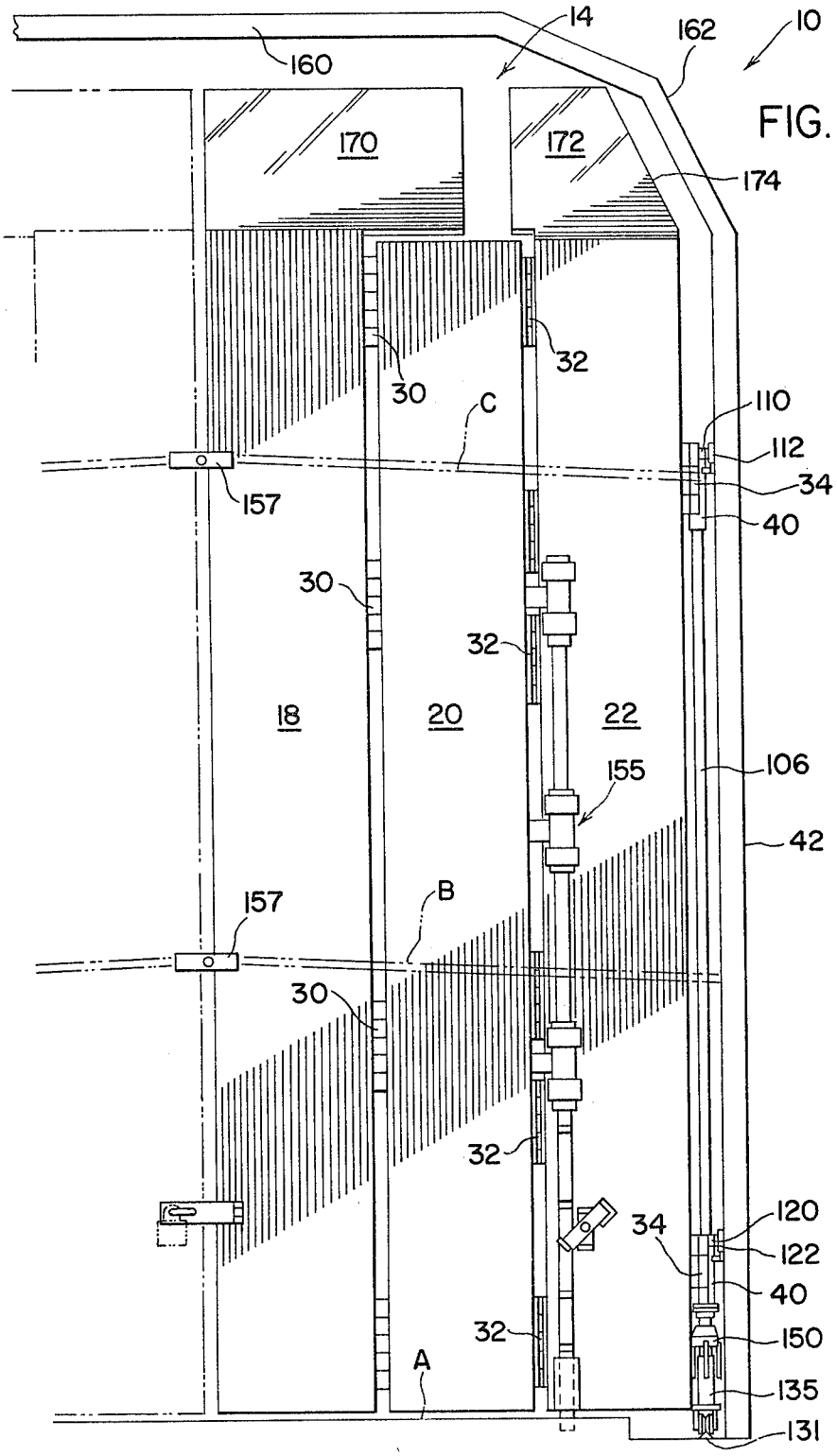
FIG. 5 is an end elevational view of one-half of the rail car of FIG. 1 showing a door combination in unfolded closed position.

The rail car 10 has an end opening which has its left-hand half closed by a three-paneled door set 12 and its right-hand half closed by a three-paneled door set 14. Car 10 is of the closed three-tier automobile transport type, including three decks, A, B and C, respectively, on which ladings such as vehicles are stored for transit. As seen in FIG. 2, wherein the door panel set 14 is shown, the doors are capable of assuming two illustrated positions. In the full view position of FIG. 2, the door panel set 14 is in the unfolded closed position. The folded open storage position within the car is shown in phantom.

The hinge arrangement which makes this possible will be seen by referring to door panel set 14 in FIG. 2 wherein panels 18, 20 and 22 are shown in the closed position. The adjacent edges of the three panels 18, 20 and 22 have hinges welded thereto. The panels 18 and 20 have an outwardly disposed hinge 30 with leaves welded to their respective and adjacent edges and the panel 22 and the adjacent edge of panel 20 have an inwardly extending hinge 32 similarly welded to their adjacent edges. Panel 22 has a hinge 34 with a leaf welded to its edge and a leaf welded to a pipe section 40.

The hinge or pivot 34 permits swinging of the three panels outwardly or inwardly toward positions parallel to the wall 42 of the car 10. The panels have a plurality of hinges 30, 32 and 34 along their length.

The three-panel door assembly 14 is mounted to the car by means of the panel 22, the hinge 34 and the pipe section 40. A pinion shaft (or pipe) 106 is journaled within the pipe section 40. The upper end of shaft 106 has rigidly attached thereto a pinion 110. Pinion 110 rotates with shaft or pipe 106 and the teeth thereof engage a rack 112.

A lower pinion 120 is mounted rigidly on shaft 106 and cooperates with a rack 122. The rack 122 is coextensive and parallel to rack 112 and because the pinions 110 and 120 are commonly mounted on the opposite ends of shaft 106, the top and bottom portions of door assembly 14 remain in register at all times and, in particular, during movement to and from the stored position at the inner end of racks 112 and 122.

Horizontally mounted below the shaft 106 on deck A is a track 131 which extends from the car opening to the interior of the car along and spaced from wall 42. A roller cage or hanger 133 is mounted by means of welding to the lower end of a pipe 135. The lower end of shaft 106 is journaled in pipe 135. Alternatively, an extension may be welded to the end thereof projecting downwardly for engagement with a thrust bearing (not shown). A roller movably supports the door assembly 14 for movement along track 131 to and from the storage position.

The pinion 110 is engaged by a spring biased pawl 140 which acts to positively lock the pinion in the storage position at its innermost end of travel on the rack 112. The shaft 106 is manually driven by crank means in the form of a housing or power wheel 150. A locking device generally indicated by the numeral 155 cooperates with T-shaped members 157 for selectively locking the door assemblies in their unfolded closed positions.

In order to maximize the interior height of the car while still being within the approved Association of American Railroads' clearance diagrams, the roof structure is made up of a horizontal central portion 160 and inwardly and upwardly directed portions 162 on either side thereof attached to the upper portion of the car side walls 42.

The inwardly and upwardly directed portions 162 of the roof structure are typically angled with respect to the car side walls 42 at an angle of approximately 45 to 75 degrees.

The door panels 18 and 22 are provided with door top panel portions or extension panels 170 and 172 respectively. The top panel portion 170 is attached to the top of the panel 18 and extends laterally over adjacent panel 20. The top panel portion 172 is attached to the top of door panel 22 and also extends laterally over panel 20, at least sufficiently to cover hinge 32 which joins panels 20 and 22. The top panel portion 172 is provided with an edge 174 which is inwardly and upwardly directed in the same direction as is roof structure portion 162 to provide clearance thereof.

Top panel portions 170 and 172 extend from the top of the door assemblies angularly inwardly relative to the opening and the plane formed by the unfolded closed main door panels 18, 20 and 22 and are in spaced relation with the roof structure. The angle of the top panel portions 170 and 172 and the space between them and their space from the roof structure horizontal portion 160 and inwardly and upwardly directed portion 162 are of such magnitude that when the door assemblies are in the unfolded closed position, the end opening portion above the door assemblies is substantially closed. The magnitude, however, is chosen such that when the panels are pivotally moved from the unfolded closed position to the folded open position and to storage along the rail car side walls 42, and back, each of the top panel portions 170 and 172 clears the other top panel portion and the roof structure sufficiently for movement relative thereto. In the preferred embodiment, the angular relation of the top panel portions 170 and 172 relative to the main door panels 18, 20 and 22 approximates the inwardly and upwardly directed angle that the roof structure portion 162 makes with the rail car side walls 42.

It will be seen that with this arrangement and with the spacing provided over the panel 20 between top panel portions 170 and 172 that the required clearance during the folding open, unfolding closing and storing operations is provided, therefore providing for substantially complete closing of the end opening of the rail car by the unfolded closed doors and yet solving the problem of storage of the folded open doors by permitting their entrance into the rail car cavity along the inside of car walls 42.

I claim:

1. In a rail car having:

an interior cavity defined partially by vertical rail car side walls and a roof structure with an inwardly and upwardly directed portion to improve car clearance, an end opening for loading and unloading lading, at least one door assembly including a plurality of main panels each pivotally movable with respect to the other for closing at least a portion of said end opening, pivoted first mounting means for moving said door assembly between an open position and a closed position, second mounting means for moving said pivoted first mounting means in directions toward and away from the intermediate portion of said rail car to permit storage of at least a portion of said door assembly along said rail car side wall and means for selective removal of said portion from storage, the improvement comprising:

top panel portions at the top of said door assembly directed angularly inwardly and spaced from each other and said roof structure, the angle of the top panel portions, the space between each of said top panel portions and every other top panel portion and the spacing of the top panel portions from said roof structure all being of such magnitude that when said door assembly is in said closed condition, said end opening portion above said door assembly is substantially closed, and when said panels are pivotally moved from said closed position to said open position and to storage along said rail car side wall, and back, each of said top panel portions clears every other top panel portion and said roof structure sufficiently for movement relative thereto.

2. The rail car of claim 1 in which the top panel portions have an angle with respect to the plane of the main panels which approximates the angle of the inwardly and upwardly directed portion of the roof structure.

3. The rail car of claim 1 in which the door assembly includes three main panels and two top panel portions.

4. The rail car of claim 4 in which the top panel portions extend from two main panels which are separated by an intermediate main panel.

5. The rail car of claim 4 in which at least one of the top panel portions projects laterally over the intermediate main panel.

6. The rail car of claim 1 in which the top panel portion adjacent said roof structure portion has an edge inwardly and upwardly directed in the same direction as is said roof structure portion.

7. The rail car of claim 1 in which said second mounting means is a track for supporting said door combination and a rack and pinion combination for selectively driving said door combination into and out of storage along said rail car side wall.

8. A method of substantially closing the end of a closed multi-decked automobile transit rail car having vertical rail car side walls and a roof structure with an inwardly and upwardly directed portion to improve car clearance, by means of multiple panel folding doors having the capability of being moved into and out of storage along an inside wall of said rail car which includes the combination of procedural steps of:

extending at least some of the panels of the multiple panel folding doors angularly inwardly and upwardly so as to fit closely adjacent to the roof structure when said doors are in an unfolded closed position by means of top panel portions, sizing, orienting and spacing said top panel portions such that the angle of the top panel portions relative to the opening, the spaces between each top panel portion and the spaces between the top panel portions and the roof structure, are sufficient for movement of the top panel portions relative to each other and the roof structure, and selectively moving said doors from a stored, folded and open position along the inside wall of said rail car to a closed unfolded position in which the end opening of said rail car is substantially closed to prevent vandalism, pilferage and unauthorized entry.

9. The procedural combination of steps of claim 8 in which said step of selectively moving said doors from a stored, folded and open position to a closed unfolded position includes the steps of:

providing tracks to support and rack and pinion drive mechanisms to drive said doors, rotating said pinions to drive said doors along said tracks and racks, and pivoting said door panels relative to each other into a co-planer relationship to close said opening.

10. The procedural combination of steps of claim 8 in which the orienting step is performed so as to create an angle of the top panel portions with respect to the door panels which approximates the angle of the inwardly and upwardly directed portion of the roof structure.

* * * * *